United States Patent [19]

Gaines et al.

[11] Patent Number: 4,953,232

[45] Date of Patent: Sep. 4, 1990

[54] COLLAR PROTECTOR

[76] Inventors: Lee R. Gaines, 410 A Rico St., Salinas, Calif. 93907; George Spector, 233 Broadway Rm. 3815, New York, N.Y. 10007

[21] Appl. No.: 361,642

[22] Filed: Jun. 5, 1989

[51] Int. Cl.[5] ..... A41B 3/00

[52] U.S. Cl. ..... 2/60; 2/46; 2/131; 2/139

[58] Field of Search ..... 2/60, 132, 131, 139, 2/140, 155, 156, 157

[56] References Cited

U.S. PATENT DOCUMENTS

| | | | |
|---|---|---|---|
| 2,182,582 | 12/1939 | Cohen | 2/60 |
| 2,514,646 | 7/1950 | Johnson | 2/60 |
| 2,633,576 | 4/1953 | Powers et al. | 2/60 |
| 2,634,420 | 4/1953 | Jackson | 2/60 |
| 2,637,034 | 5/1953 | Smith | 2/60 |
| 3,022,514 | 2/1962 | Kaiser | 2/60 |
| 3,200,413 | 8/1965 | Vaughan | 2/60 |
| 3,860,967 | 1/1975 | Tedesco | 2/139 |
| 4,008,494 | 2/1977 | Hicks | 2/60 |
| 4,190,903 | 4/1980 | Kinsella | 2/60 |
| 4,653,119 | 3/1987 | Kaiser | 2/60 |

*Primary Examiner*—Werner H. Schroeder
*Assistant Examiner*—Jeanette E. Chapman

[57] ABSTRACT

A collar protector for a shirt is provided that will cover both the neck band and outside flap portion of the collar and be removably attached thereto, so that the protector will prevent salt and moisture from damaging the complete collar of the shirt.

2 Claims, 1 Drawing Sheet

COLLAR PROTECTOR

BACKGROUND OF THE INVENTION

The instant invention relates generally to protective covers for shirt collars and more specifically it relates to a collar protector for a shirt.

Numerous protective covers for shirt collars have been provided in prior art that are adapted to engage the inside bands of the shirt collars to protect them from the necks of the wearers of the shirts. For example, U.S. patents numbered 2,182,582; 3,022,514 and 4,653,119 all are illustrative of such prior art. While these units may be suitable for the particular purpose to which they address, they would not be as suitable for the purposes of the present invention as heretofore described.

SUMMARY OF THE INVENTION

A primary object of the present invention is to provide a collar protector for a shirt that will overcome the shortcomings of the prior art devices.

Another object is to provide a collar protector for a shirt that is fabricated out of an absorbent, comfortable fabric which will eliminate neck ring and salt from the complete collar.

An additional object is to provide a collar protector for a shirt that will cover both the neck band and outside flap portion of the collar and be removably attached thereto.

A further object is to provide a collar protector for a shirt that is simple and easy to use.

A still further object is to provide a collar protector for a shirt that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
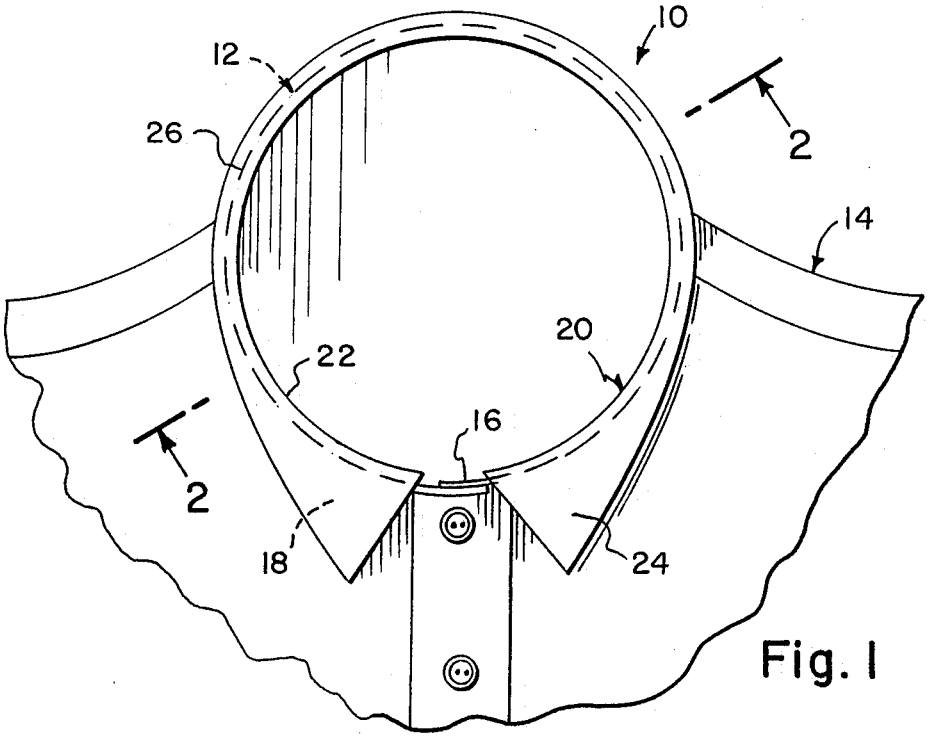
FIG. 1 is a view of a shirt having the collar protector thereon.
Figure 2:
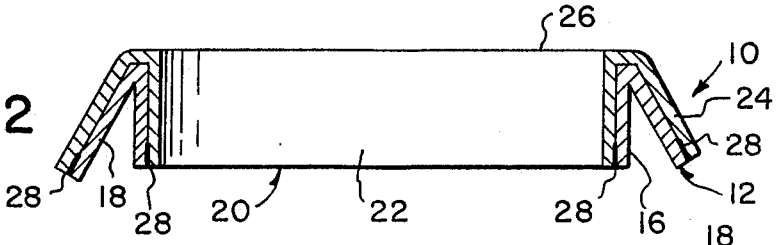
FIG. 2 is a cross sectional view taken along line 2—2 in FIG. 1.
Figure 3:
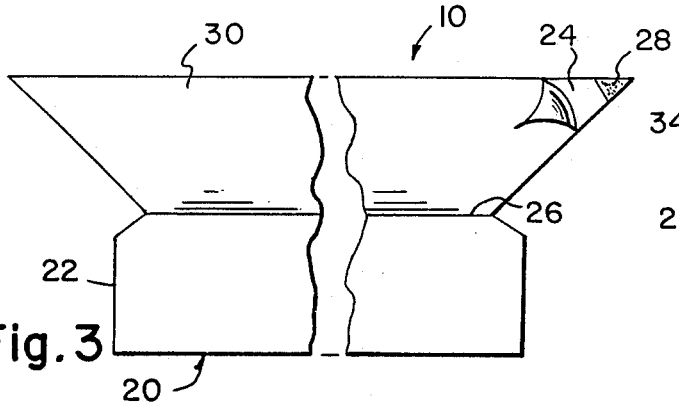
FIG. 3 is a flat out developed plan view of the collar protector.

Turning now descriptively to the drawings, in which similar reference characters denote similar elements throughout the several views, FIGS. 1 through 3 illustrate a disposable protector 10 for a collar 12 of a shirt 14. The collar 12 has a neck band 16 and outside flap 18. The protector 10 consists of a piece of thin moisture absorbent fabric material 20 having a first portion 22 approximately the size and shape of the neck band 16 of the collar 12 and a second portion 24 approximately the size and shape of the outside flap 18 of the collar 12 with a fold line 26 therebetween. A plurality of pressure sensitive adhesive spots 28 are applied to the first and second portions in order that the same may be removably attached to the band 16 and the outside flap 18, respectively, of the shirt 14. The first portion 22 of the piece of fabric material 20 can be removably attached to inner surface of the neck band 16, fold over on the fold line 26 and the second portion 24 of the piece of fabric material 20 can be removably attached to outer surface of the outside flap 18 to absorb salt and moisture from the wearer of the shirt 14 to prevent soiling of the neck band 16 and outside flap 18 of the collar 12.

Figure 4:
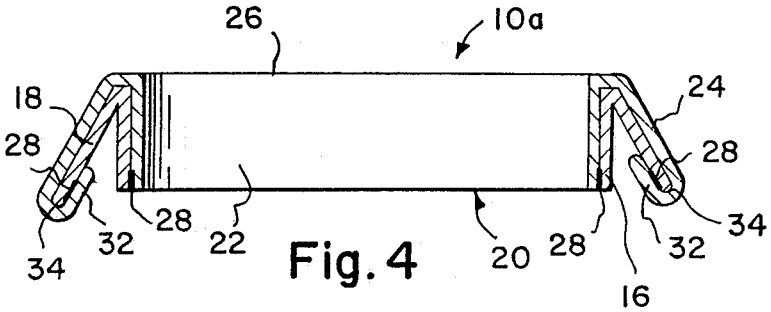
FIG. 4 is a cross sectional view similar to FIG. 2 showing a modified collar protector in which the edges are folded over the edges of the outside flap of the collar.

A modified disposable protector 10*a* is shown in FIG. 4. The second portion 24 of the piece of fabric material 20 can further include a plurality of extended edge segments 32 so that the extended edge segments can be folded over the edges 34 of the outside flap 18 of the collar 12 to be removably attached to inner surface of the outside flap by the pressure sensitive adhesive spots 28.

Figure 5:
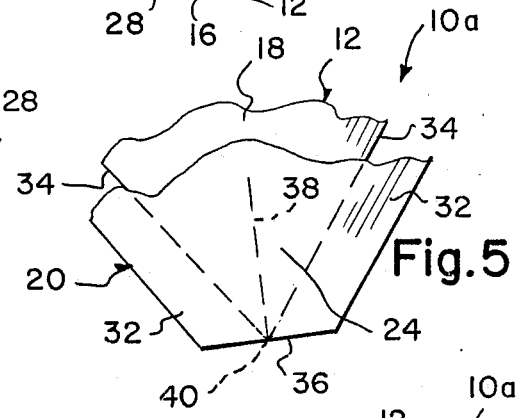
FIG. 5 is a top view with parts broken away of one tip portion of outside flap showing the fold over portions with a cut line perpendicular to an angle bisector of the modified collar protector before being secured to underside of the outside flap.
Figure 6:
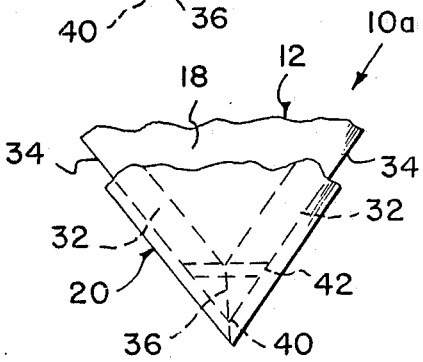
FIG. 6 is a top view similar to FIG. 5 showing the modified collar protector secured to underside of the outside flap with adhesive at junction of the fold over portions.

FIG. 5 shows the extended edge segments 32 of the second portion 24 of the piece of fabric material 20 having a cut line side 36 perpendicular to an angle bisector 38 of one tip 40 of the outside flap 18. When the extended edge segments 32 are folded over the edges 34, at the tip 40 of the outside flap 18, as shown in FIG. 6, the cut line side 36 will fold to abut together at underside thereof. An adhesive strip 42 can be used to secure the abutting cut line side 36 of the extended edge segments 32 for producing an even fold thereto.

The pressure sensitive adhesive spots 28 and the adhesive strip 42 can be replaced by other types of fasteners such as VELCRO, snaps, etc. to accomplish the same results.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disposable protector for a collar of a shirt, the collar having a neck band and outside flap with usual angular spaced corners, said protector comprising:

(a) a piece of thin moisture absorbent fabric material having a first portion approximately the size and shape of the neck band of the collar and a second portion sized to cover said outside flap and corners with a fold line between said portions;

(b) a plurality of pressure sensitive adhesive spots carried on one side of said piece of fabric material; and (c) a removable backing sheet to cover said pressure sensitive adhesive spots and adapted to be removed so that said first portion of said piece of fabric material can be removably attached to inner surface of the neck band, folded over on the fold line and said second portion of said piece of fabric material can be removably attached to outer surface of the outside flap to absorb salt and moisture from the wearer of the shirt to prevent soiling of the neck band and outside flap of the collar, wherein said second portion of said piece of fabric material further includes a plurality of extended edge segments so that said extended edge segments can be folded over the edges of the outside flap of said collar and corners to be removably attached to inner surface of said outside flap and corner by said pressure sensitive adhesive spots; said extended segments having opposing forward ends adapted to abut each other when folded over said corners.

2. A disposable protector as recited in claim 1, further including:

(a) said forward ends being disposed along a line perpendicular to the angle bisector of each said corner so that when said extended edge segments are folded over the edges of each corner said ends will fold to abut together at underside thereof along the angle bisector;

(b) an adhesive strip to secure said abutting cut line side of said extended edge segments for producing an even fold thereto.

* * * * *